US006709529B1

(12) United States Patent
Mekwinski

(10) Patent No.: US 6,709,529 B1
(45) Date of Patent: Mar. 23, 2004

(54) ROOF BRUSH AND METHOD OF USE

(76) Inventor: Julius Mekwinski, 110 Keyes Ct., Sanford, FL (US) 32773

( * ) Notice: Subject to any disclaimer, the term of this patent is extended or adjusted under 35 U.S.C. 154(b) by 110 days.

(21) Appl. No.: 10/007,540

(22) Filed: Dec. 10, 2001

(51) Int. Cl.[7] ..... G08B 7/08; A46B 15/00; A47L 13/10

(52) U.S. Cl. ..... 134/6; 134/34; 15/111; 15/144.1; 15/160

(58) Field of Search ..... 134/6, 34; 15/111, 15/144.1, 144.3, 144.4, 160, 172, 236.04, 236.01, 245; 401/9, 23, 24, 48, 99, 268, 282, 292; 37/196, 197, 289

(56) References Cited

U.S. PATENT DOCUMENTS

| | | | | | |
|---|---|---|---|---|---|
| 2,720,409 | A | | 10/1955 | Griffith | |
| 2,817,867 | A | | 12/1957 | Bugbird | |
| 2,896,239 | A | | 7/1959 | Bugbird | |
| 3,773,375 | A | | 11/1973 | Nehls | |
| 4,303,348 | A | * | 12/1981 | O'Brien | 401/137 |
| 4,304,498 | A | * | 12/1981 | George | 401/9 |
| 4,848,818 | A | | 7/1989 | Smith | |
| 5,271,682 | A | * | 12/1993 | Realdon | 401/37 |
| 5,309,654 | A | * | 5/1994 | Mathis | 37/284 |
| 5,425,589 | A | * | 6/1995 | Griffin et al. | 401/42 |
| 5,442,831 | A | | 8/1995 | Yamada | |
| 5,464,481 | A | | 11/1995 | Lietz, Jr. et al. | |
| 5,769,324 | A | * | 6/1998 | Lenhart | 239/320 |
| 5,853,209 | A | | 12/1998 | McDermott | |
| 5,887,314 | A | | 3/1999 | Jordan, Jr. | |
| 5,890,259 | A | * | 4/1999 | Sarac | 16/422 |
| 6,058,551 | A | | 5/2000 | Tagliavini | |
| 6,119,311 | A | | 9/2000 | Lavallee | |
| 6,142,693 | A | * | 11/2000 | Bruggeman et al. | 401/176 |
| 6,155,620 | A | * | 12/2000 | Armstrong | 294/57 |
| 6,256,829 | B1 | | 7/2001 | Hatch et al. | |

FOREIGN PATENT DOCUMENTS

DE 29718509 U * 11/1999

OTHER PUBLICATIONS

Derwent abstract of AU 8288–143, Mar. 17, 1983.*

* cited by examiner

*Primary Examiner*—Alexander Markoff
(74) *Attorney, Agent, or Firm*—Paul S. Rooy, P.A.

(57) ABSTRACT

A roof brush and method of use. The roof brush comprises a horizontal arm pivotally attached to a vertical arm at a pivot assembly. A cleaning head is disposed on the vertical arm, and has bristles at a predetermined bristle angle to the horizontal arm to maximize the effectiveness of the instant roof brush in cleaning debris off a roof. The cleaning head also comprises a cleaning head horn to catch the cleaning head from falling off a roof in the event it is pulled to far during a cleaning stroke. Both the horizontal arm and the vertical arm may be made of a plurality of telescoping members, so the roof brush may be sized for the particular roof to be cleaned, then collapsed for storage or transportation. One alternate embodiment roof brush provides a hose attachment which permits cleaning solution to be discharged from the cleaning head at the bristles. Another alternate embodiment cleaning brush provides a bolt and butterfly nut to pivotally attach the horizontal and the vertical arms. The method comprises the steps of sizing the roof brush for a roof to be cleaned, positioning the roof brush on the roof, using the vertical arm to pull the cleaning head through a cleaning stroke, and repositioning the cleaning head on the roof by pulling down and then twisting the vertical arm.

23 Claims, 5 Drawing Sheets

ROOF BRUSH AND METHOD OF USE

BACKGROUND OF THE INVENTION

1. Field of the Invention

This invention relates to apparatus and methods for cleaning buildings, and in particular to a roof brush and method of use.

2. Background of the Invention

A cleaning problem associated with roofs is the accumulation of leaves and twigs that builds up from surrounding trees and large plants over time. This problem is especially pronounced in the case of screen enclosure roofs, such are commonly used over swimming pools. Surrounding trees tend to drop their leaves, berries, twigs, and flowers onto the screen pool enclosure, and the result is a load of tree trash accumulated on the screen enclosure roof. The problem then becomes removing this debris from the pool enclosure screen roof.

The problem is tougher than it might seem at first glance. Pool enclosures are typically made of aluminum extruded frame, with screen material covering the aluminum frame. Thus, unlike most building roofs, screen roofs are not safe to walk on, because an individual so doing would fall through the screen.

Even if a would-be screen roof cleaner only walked on the extruded aluminum roof frame, such a position is precarious, and if the individual were to fall, he could injure himself. In addition, many aluminum roof frames aren't strong enough to safely walk on.

One cleaning method which has been attempted is using a hose to blast the vegetation off the screen roof from the inside of the screen room. Unfortunately, this approach has the effect of turning the accumulated vegetable matter into a soggy mess, considerably heavier than the dry mess we started out with. Once the accumulated vegetable matter is wet, it becomes even more difficult to remove than when dry.

Existing Designs

A number of patents have been granted for articulated brooms and other cleaning devices capable of cleaning hard-to-reach places. U.S. Pat. Nos. 2,817,867 and 2,896,239 were granted to Mr. Bugbird for gutter cleaning devices. While these patents taught a brush and a broom respectively held to a handle, the angle between the broom or brush and the handle was only adjustable from the ground, and thus these devices were not suitable for cleaning wide expanses of screen roof. In addition, no provision was taught for keeping the brush or broom on the roof at the end of a cleaning stroke.

U.S. Pat. Nos. 6,119,311, 5,853,209 and 3,773,375 were granted Lavallee, McDermott and Nehls respectively. While these patents taught a brush or other cleaning device hingedly attached to a handle, they all taught methods of use where the angle between the brush and the handle was set on the ground, and was not adjustable during use. For this reason, it would be difficult to keep the brush in contact with the roof to be cleaned.

Thus, it would be desirable to provide a roof cleaning brush which could have an angle between its brush and its handle adjustable during use. This feature would enable the brush to remain in contact with a roof being cleaned by virtue of gravity pushing the brush down onto the roof being cleaned.

In addition, it would be desirable to provide the brush portion of the roof brush with a horn to prevent the brush from falling off the roof being cleaned at the end of each stroke.

SUMMARY OF THE INVENTION

Accordingly, it is an object of the present invention to provide a roof brush which is capable of cleaning a screen building roof which permits an individual operating the roof brush to remain standing on the ground while cleaning the screen building roof. Design features allowing this object to be accomplished include a horizontal arm pivotally attached to a vertical arm at a pivot assembly, and a cleaning head at an extreme of the horizontal arm opposite the pivot assembly. Advantages associated with the accomplishment of this object include time savings, elimination of the requirement of a ladder, and increased cleaner safety.

It is another object of the present invention to provide a roof brush which permits a cleaning head to be pulled all the way to the edge of a screen roof being cleaned, so that debris on the screen roof can be brushed off the screen roof, without the cleaning head falling off the edge of the screen roof. Design features allowing this object to be accomplished include a cleaning head horn attached to a cleaning head. Benefits associated with the accomplishment of this object include time saved by not having to re-position the cleaning head on the screen roof, as well as better cleaning of the screen roof.

It is still another object of this invention to provide a roof brush which is capable of cleaning a screen roof with a liquid solution while brushing the screen roof. Design features enabling the accomplishment of this object include at least one horizontal arm bore, a hose attachment on the horizontal arm communicating with the horizontal arm bore, a cleaning head manifold communicating with the horizontal arm bore, and at least one cleaning head aperture in the cleaning head. An advantage associated with the realization of this object is better quality cleaning of the screen roof.

It is another object of the present invention to provide a roof brush which can be easily swung into position on a screen roof to be cleaned. Design features allowing this object to be accomplished include a horizontal arm pivotally attached to a vertical arm at a pivot assembly, and a cleaning head at an extreme of the horizontal arm opposite the pivot assembly. Benefits associated with the accomplishment of this object include time saved positioning the cleaning head and elimination of the necessity of using a ladder to position the cleaning head.

It is still another object of this invention to provide a roof brush whose design is optimized to remove organic debris from screen roofs. Design features enabling the accomplishment of this object include a cleaning head having bristles attached at a bristle angle of 72°±20° relative to a horizontal arm. Advantages associated with the realization of this object include more efficient screen roof cleaning, along with the attendant cost and time savings.

It is another object of the present invention to provide a roof brush method of use which provides safe and easy roof cleaning. Design features allowing this object to be accomplished include the method steps of sizing the roof brush for a roof to be cleaned, positioning the roof brush on the roof, and using the vertical arm to pull the cleaning head through a cleaning stroke. Benefits associated with the accomplishment of this object include safety and efficiency.

It is still another object of this invention to provide a roof brush method of use which permits the roof brush cleaning head to be re-positioned on the roof, from the ground. Design features enabling the accomplishment of this object include the method steps of pulling down and then twisting the vertical arm. Advantages associated with the realization of this object include safety and efficiency.

BRIEF DESCRIPTION OF THE DRAWINGS

The invention, together with the other objects, features, aspects and advantages thereof will be more clearly understood from the following in conjunction with the accompanying drawings.

Five sheets of drawings are provided. Sheet one contains FIG. 1. Sheet two contains FIG. 2. Sheet three contains FIGS. 3 and 4. Sheet four contains FIGS. 5 and 6. Sheet five contains FIGS. 7 and 8.

DETAILED DESCRIPTION OF THE PREFERRED EMBODIMENT

Figure 1:
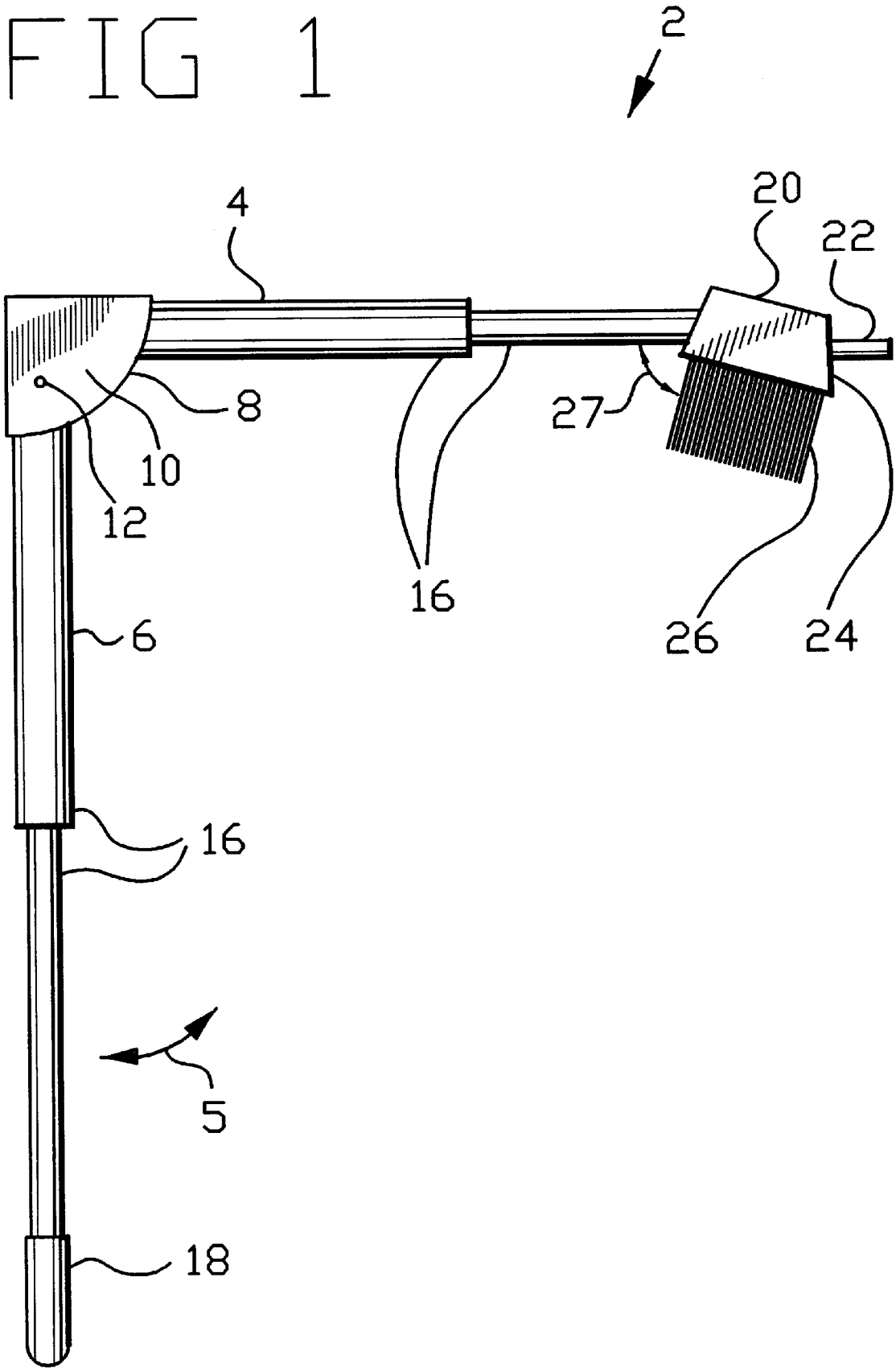
FIG. 1 is a side isometric view of a roof brush.
Figure 2:
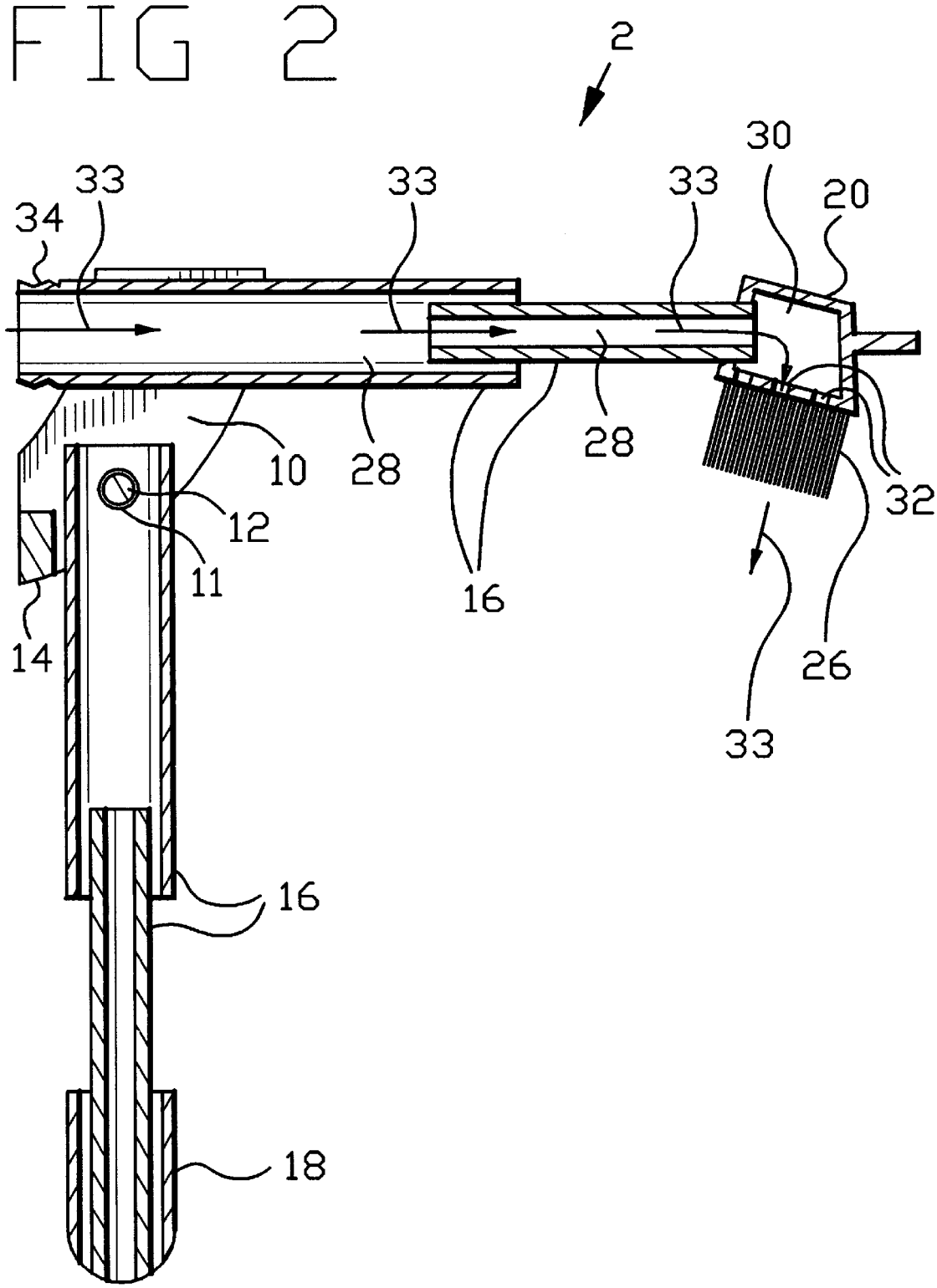
FIG. 2 is a side cross-sectional view of a roof brush.

Referring now to FIG. 1 we observe a side isometric view of roof brush 2. FIG. 2 is a side cross-sectional view of roof brush 2. Referring to these two figures, roof brush 2 comprises horizontal arm 4 pivotally attached to vertical arm 6 at pivot assembly 8. Cleaning head 20 is disposed at an extreme of horizontal arm 4 opposite pivot assembly 8. Handle 18 is disposed at an extreme of vertical arm 6 opposite pivot assembly 8.

Horizontal arm 4 is free to pivot relative to vertical arm 6 as indicated by arrow 5 in FIG. 1. The pivotal movement of horizontal arm 4 relative to vertical arm 6 is limited to being substantially within a plane containing horizontal arm 4 and vertical arm 6, due to the pivotal attachment between horizontal arm 4 and vertical arm 6 provided by shaft 12 through side plates 10 and vertical arm bore 11. In addition, side plates 10 help to limit the pivotal movement of horizontal arm 4 relative to vertical arm 6 to being substantially within a plane containing horizontal arm 4 and vertical arm 6, side plates 10 being substantially parallel to a plane containing horizontal arm 4 and vertical arm 6.

Figure 8:
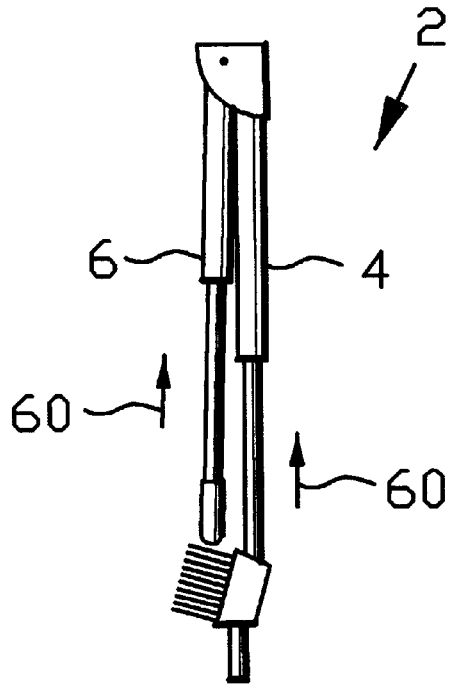
FIG. 8 is a side view of a folded roof brush.

Horizontal arm 4 and vertical arm 6 may be comprised of two or more telescoping segments 16. Telescoping segments 16, in combination with pivot assembly 8, permit roof brush 2 to be stored in a collapsed, folded configuration as is illustrated in FIG. 8.

Figure 7:
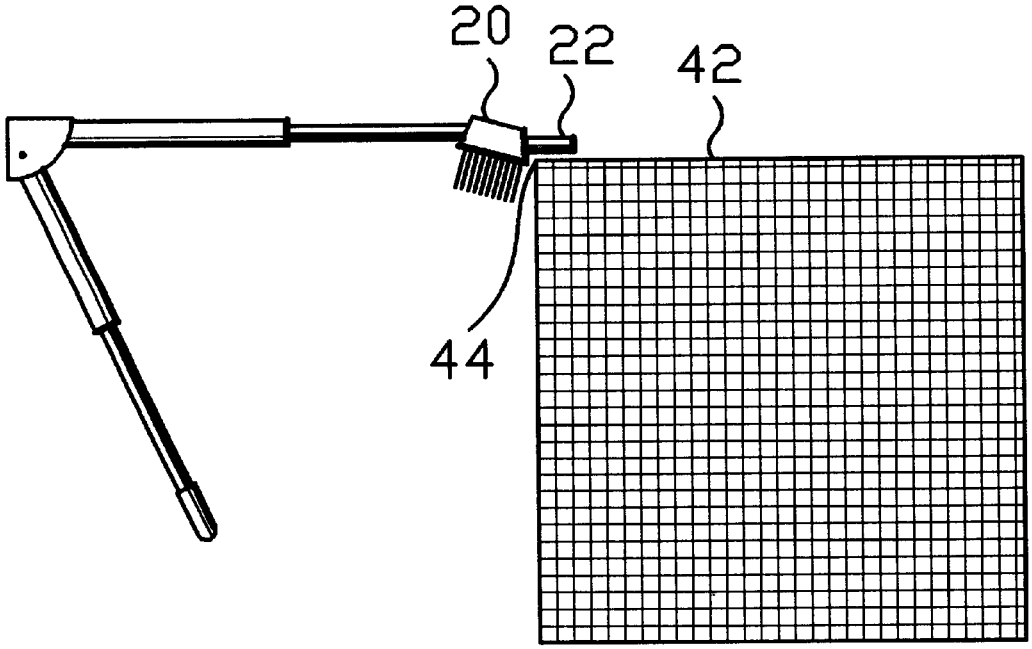
FIG. 7 is a side view of a roof brush which has been pulled too far during a stroke, whose cleaning head has fallen off the roof, and which has been saved from falling off the roof by the cleaning head horn.

Cleaning head 20 comprises cleaning head body 24 attached to an extreme of horizontal arm 4 opposite pivot assembly 8, bristles 26 disposed at a bristle angle 27 relative to horizontal arm 4, and cleaning head horn 22. Cleaning head horn 22 prevents roof brush 2 from falling off screen roof 42 at end of stroke, as is illustrated in FIG. 7.

As may be observed in FIG. 1, bristles 26 are oriented at a bristle angle 27 of 72°±20° to horizontal arm 4. It was determined experimentally that a bristle angle 27 of 72°±20° produced optimum cleaning of debris from screen roof 42.

Pivot assembly 8 comprises a pair of side plates 10 attached to diametrically opposed sides of horizontal arm 4, and to end of travel stop 14. Side plates 10 are spaced so as to slidably admit vertical arm 6. Vertical arm 6 is pivotally attached to side plates 10 by means of shaft 12 through side plates 10 and vertical arm bore 11. The pivotal travel of vertical arm 6 on shaft 12 is limited at one end by horizontal arm 4 as depicted in FIG. 8, and at the opposite end by end of travel stop 14. In the preferred embodiment, end of travel stop 14 was placed to limit the maximum angle between horizontal arm 4 and vertical arm 6 to 100°±20°. Thus, in the preferred embodiment, the pivotal movement between horizontal arm 4 and vertical arm 6 was limited to an arc of 100°±20°, substantially within a plane containing horizontal arm 4 and vertical arm 6.

Figure 5:
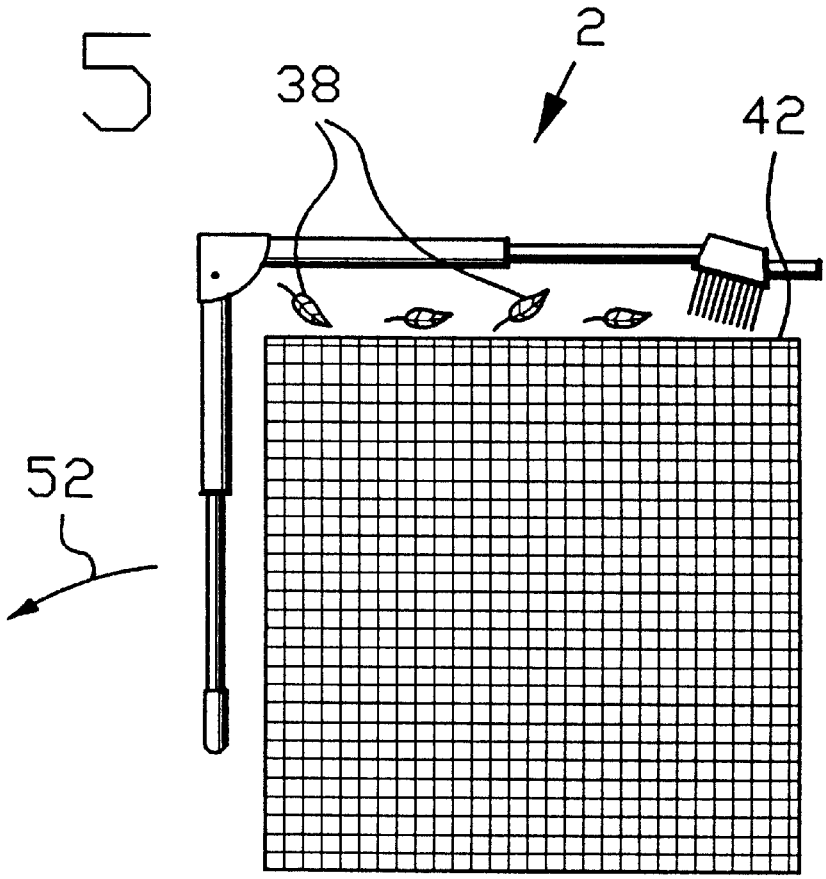
FIG. 5 is a side view of a roof brush in position on a roof, ready to clean the roof.
Figure 6:
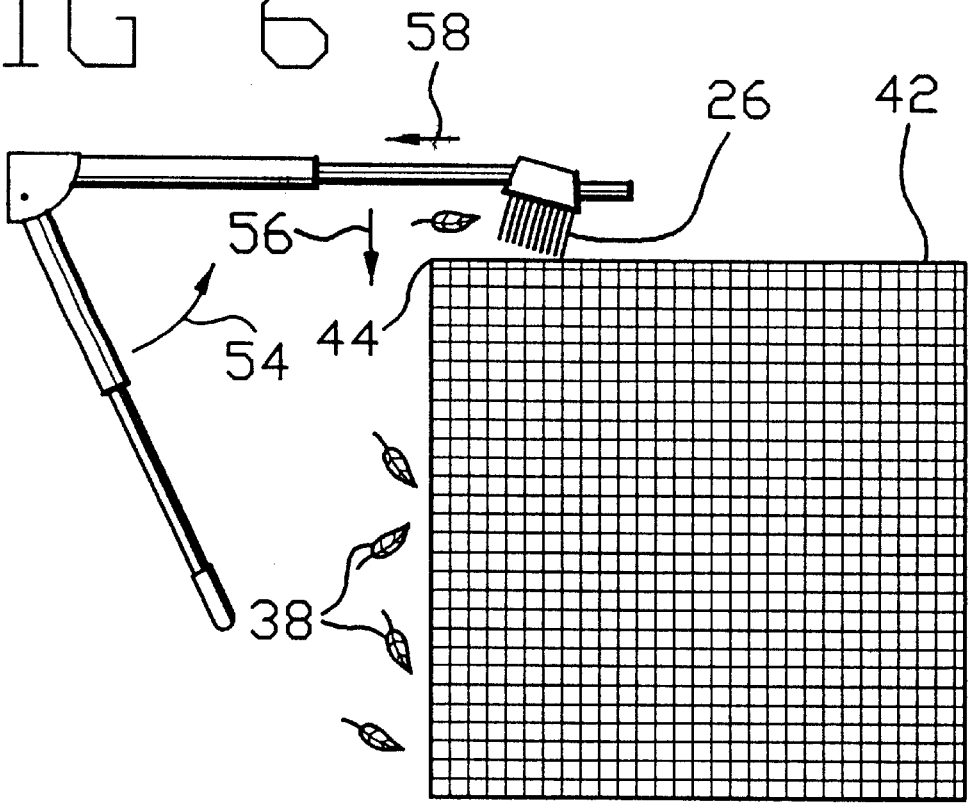
FIG. 6 is a side view of a roof brush in position on a roof close to the end of a cleaning stroke.

Side plates 10 serve to limit the movement of horizontal arm 4 relative to vertical arm 6 to coplanar pivoting. Thus, side plates 10 help stabilize horizontal arm 4 relative to vertical arm 6 in order to permit swinging cleaning head 20 sideways as indicated by arrow 50 in FIG. 4, by merely twisting vertical arm 6. In addition, the stability imparted by side plates 10 permit good operator control of the instant roof brush 2 during cleaning strokes as illustrated in FIGS. 5–7.

FIG. 2 depicts an alternate embodiment of roof brush 2 wherein horizontal arm 4 comprises horizontal arm bore 28 communicating with cleaning head manifold 30 disposed in cleaning head 20. Cleaning head manifold 30 communicates with the exterior of cleaning head 20 through cleaning head apertures 32, disposed at the base of bristles 26. Horizontal arm bore 28 communicates with the exterior of horizontal arm 4 through hose attachment 34.

In the alternate embodiment roof brush 2 depicted in FIG. 2, a hose may be attached to horizontal arm 4 at hose attachment 34. Liquid cleaning solution supplied by the hose courses through hose attachment 34, horizontal arm bore 28 and cleaning head manifold 30, and thence exits cleaning head manifold 30 at bristles 26 through cleaning head apertures 32. This path of the liquid cleaning solution is indicated by arrows 33 in FIG. 2. In this manner, cleaning solution can be delivered to any desired location an screen roof 42, in order to maximize the cleaning achieved of screen roof 42.

In the roof brush 2 embodiments discussed thus far, vertical arm 6 is free to pivot relative to horizontal arm 4, constrained at its limits only by horizontal arm 4 at one end of its travel, and by end of travel stop 14 at an opposite end of its travel. In another alternate embodiment of roof brush 2, shaft 12 is a bolt through side plates 10 and vertical arm bore 11, with a butterfly nut at one end. The action of tightening the butterfly nut tightens side plates 10 onto vertical arm 6, thus angularly immobilizing vertical arm 6 relative to horizontal arm 4. Where a given cleaning application would benefit from a fixed angle between horizontal arm 4 and vertical arm 6, the bolt and butterfly nut substituted for shaft 12 provides that function.

Figure 3:
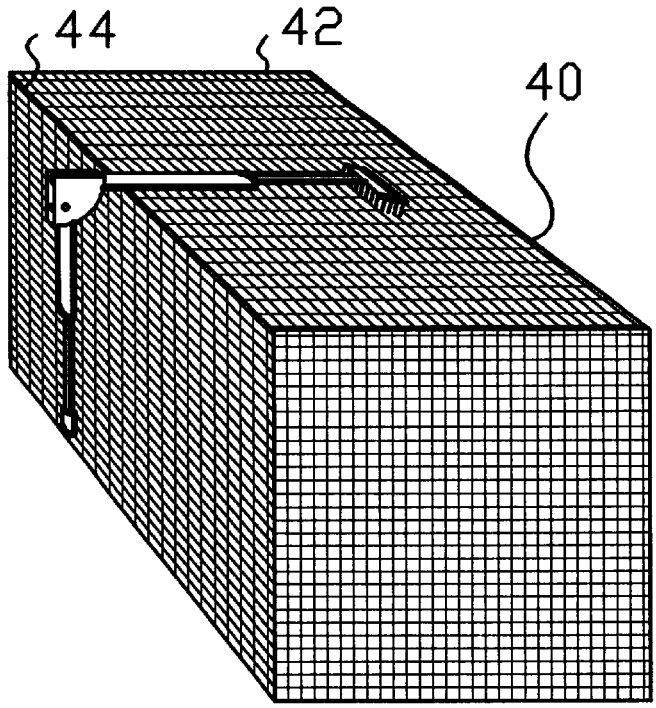
FIG. 3 is a side quarter isometric view of a roof brush in position on a roof, ready to clean the roof.

When roof brush 2 is to be used to clean a roof, first telescoping segments 16 of horizontal arm 4 and vertical arm 6 are extended as required to fit the height and width of the roof to be cleaned. Then roof brush 2 is positioned as indicated in FIG. 3, a side quarter isometric view of roof brush 2 in position on screen building 40 having screen roof 42, ready to clean screen roof 42.

Figure 4:
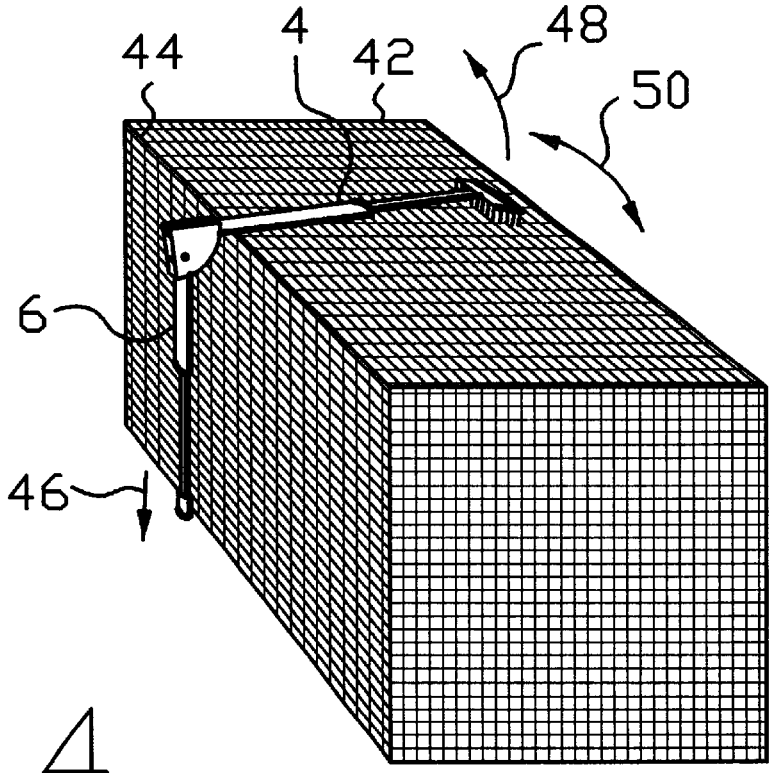
FIG. 4 is side quarter isometric view of a roof brush in a swingable position on a roof, ready to be swung sideways to re-position the roof brush on the roof.

Roof brush 2 may be re-positioned where desired on screen roof 42 as depicted in FIG. 4. Vertical arm 6 is pulled downwards as indicated by arrow 46, which due to the fulcrum effect of screen roof edge 44 on the lever which is horizontal arm 4, and due to the pivotal connection between horizontal arm 4 and vertical arm 6, has the effect of raising cleaning head 20 as indicated by arrow 48 in FIG. 4. FIG. 4 is side quarter isometric view of roof brush 2 in a swingable position on screen roof 42, ready to be swung sideways. As may be observed in FIG. 4, once cleaning head 20 is raised off screen roof 42 by pulling down on vertical arm 6, cleaning head 20 may swung laterally as indicated by arrow 50 to any position on screen roof 42 desired simply by twisting vertical arm 6.

Once cleaning head 20 is in the desired position on screen roof 42, a cleaning stroke may be initiated to move debris 38 off screen roof 42. Debris 38 may be comprised of leaves, twigs, and other foreign matter which tends to accumulate on roofs over time. FIG. 5 is a side view of a roof brush 2 in position on a roof, ready to initiate a cleaning stroke to move debris 38 off screen roof 42. Note bristle angle 27 has been optimized at 72°±20° in order to produce optimum cleaning of debris 38 from screen roof 42.

FIG. 5 is a side view of roof brush 2 in position on screen roof 42, ready to clean screen roof 42. FIG. 6 is a side view of roof brush 2 in position on screen roof 42 close to the end of a cleaning stroke. FIG. 7 is a side view of roof brush 2 which has been pulled too far during a stroke, whose cleaning head 20 has fallen off screen roof 42, and which has been saved from falling off screen roof 42 by cleaning head horn 22. A cleaning stroke is performed by pulling backwards on vertical arm 6 as indicated by arrow 52 in FIG. 5. The action of pulling backwards on vertical arm 6 as indicated by arrow 52 in FIG. 5, in combination with the pivotable attachment between vertical arm 6 and horizontal arm 4 (indicated by arrow 54 in FIG. 6), has the effect of pulling cleaning head 20 towards screen roof edge 44 as indicated by arrow 58. Throughout the cleaning stroke, gravity holds cleaning head 20 in contact with screen roof 42 as indicated by arrow 56, thus ensuring that bristles 26 move debris 38 in the desired direction.

FIG. 6 is a side view of roof brush 2 in position on screen roof 42 close to the end of a cleaning stroke. Debris 38 is being moved over screen roof edge 44 off screen roof 42.

After the end of a cleaning stroke, vertical arm 6 is pushed in a direction opposite arrow 52 in FIG. 6 in order to reposition cleaning head 20 for the next cleaning stroke. If cleaning head 20 must be re-positioned laterally, such can be easily accomplished as described previously in connection with FIG. 4. Once cleaning head 20 is in position, another cleaning stroke is initiated, and so forth until screen roof 42 has been completely cleaned.

In the eventuality that cleaning head 20 is pulled too far during a cleaning stroke, cleaning head horn 22 serves to save cleaning head 20 from falling off screen roof 42. FIG. 7 depicts such a situation, where roof brush 2 has been pulled far enough during a cleaning stroke to cause cleaning head 20 to travel beyond screen roof edge 44. Thanks to cleaning head horn 22, cleaning head 20 doesn't fall, but needs only be re-positioned on screen roof 42 in order to initiate another cleaning stroke.

After use, roof brush 2 may be folded for storage as illustrated in FIG. 8. The telescoping segments 16 of horizontal arm 4 and vertical arm 6 are collapsed as indicated by arrows 60 in FIG. 8, and horizontal arm 4 is folded against vertical arm 6.

In the preferred embodiment, horizontal arm 4, vertical arm 6, side plates 10, shaft 12 and end-of travel stop 14 were fabricated of aluminum, metal, synthetic, or other appropriate material. Bristles 26 were fabricated of organic material such as horse hair, synthetic, or other appropriate material. Handle 18 was made of rubber, synthetic, or other appropriate non-slip material.

While a preferred embodiment of the invention has been illustrated herein, it is to be understood that changes and variations may be made by those skilled in the art without departing from the spirit of the appending claims.

DRAWING ITEM INDEX

2 roof brush
4 horizontal arm
5 arrow
6 vertical arm
8 pivot assembly
10 side plate
11 vertical arm bore
12 shaft
14 end of travel stop
16 telescoping segment
18 handle
20 cleaning head
22 cleaning head horn
24 cleaning head body
26 bristles
27 bristle angle
28 horizontal arm bore
30 cleaning head manifold
32 cleaning head apertures
33 arrow
34 hose attachment
38 debris
40 screen building
42 screen roof
44 screen roof edge
46 arrow
48 arrow
50 arrow
52 arrow
54 arrow
56 arrow
58 arrow
60 arrow

I claim:

1. A roof brush comprising a horizontal arm pivotally attached to a vertical arm at a pivot assembly, said horizontal arm pivoting freely relative to said vertical arm during use, a cleaning head at an extreme of said horizontal arm opposite said pivot assembly, and a cleaning head horn attached to said cleaning head on a side of said cleaning head substantially opposite said horizontal arm, a length of said cleaning horn being sufficient to prevent said cleaning head from falling of a roof in case of over-travel, whereby said cleaning head may be saved from falling off a roof being cleaned at end of stroke.

2. The roof brush of claim 1 further comprising means of limiting said a pivotal movement of said horizontal arm relative to said vertical arm to being substantially within a plane containing said horizontal arm and said vertical arm.

3. The roof brush of claim 1 further comprising means of limiting said pivotal movement of said horizontal arm relative to said vertical arm to being an arc extending 100°±20°.

4. The roof brush of claim 2 wherein said cleaning head comprises a plurality of bristles attached to a cleaning head body, said cleaning head body being attached to said horizontal arm.

5. The roof brush of claim 4 wherein said bristles are disposed at a bristle angle relative to said horizontal arm of 72°±20°.

6. The roof brush of claim 1 wherein said means of limiting said a pivotal movement of said horizontal arm relative to said vertical arm to being substantially within a plane containing said horizontal arm and said vertical arm comprises a shaft extending through at least one bore in said vertical arm or in said horizontal arm.

7. The roof brush of claim 6 wherein said means of limiting said a pivotal movement of said horizontal arm relative to said vertical arm to being substantially within a plane containing said horizontal arm and said vertical arm further comprises a pair of substantially parallel side plates rigidly attached to diametrically opposed sides of one said arm, said side plates being spaced so as to slidably admit the other said arm, said shaft extending through said side plates and through a bore is said other arm.

8. The roof brush of claim 3 wherein said means of limiting said a pivotal movement of said horizontal arm relative to said vertical arm to being an arc extending 100°±20° comprises an end of travel stop rigidly attached to at least one said side plate.

9. The roof brush of claim 2 wherein said horizontal arm is comprised of at least two telescoping sections.

10. The roof brush of claim 2 wherein said vertical arm is comprised of at least two telescoping sections.

11. The roof brush of claim of claim 2 wherein said cleaning head comprises a cleaning head manifold and bristles, said cleaning head manifold communicates with an outside of said cleaning head through at least one cleaning head aperture disposed at said cleaning head bristles, said horizontal arm comprises a horizontal arm bore communicating with said cleaning head manifold, said horizontal arm bore communicating with an outside of said horizontal arm through a hose attachment, whereby a hose attached to said hose attachment may pump cleaning solution through said horizontal arm manifold, said cleaning manifold and said at least one cleaning head aperture to said bristles.

12. The roof brush of claim 2 further comprising a bolt and butterfly nut pivotally attaching said horizontal arm to said vertical arm, whereby an angle between said horizontal arm and said vertical arm may be fixed by tightening said butterfly nut on said bolt.

13. A roof brush comprising a horizontal arm pivotally connected to a vertical arm at a pivot assembly, said horizontal arm pivoting freely relative to said vertical arm during use, a cleaning head disposed at an extreme of said horizontal arm opposite said vertical arm, and a cleaning head horn attached to said cleaning head on a side of said cleaning head substantially opposite said horizontal arm, a length of said cleaning horn being sufficient to prevent said cleaning head from falling of a roof in case of over-travel, whereby said cleaning head may be saved from falling off a roof being cleaned at end of stroke.

14. The roof brush of claim 13 wherein said cleaning head further comprises bristles, said bristles extending from said cleaning head at a bristle head angle of 72°±20° relative to said horizontal arm.

15. The roof brush of claim 14 wherein said pivot assembly comprises at least one side plate rigidly attached to said horizontal arm, and a shaft extending through said at least one side plate and said vertical arm.

16. The roof brush of claim 15 wherein said pivot assembly further comprises an end of travel stop attached to said at least one side plate, whereby a pivotal motion of said horizontal arm relative to said vertical arm may be limited.

17. The roof brush of claim 13 wherein said horizontal arm is comprised of at least two telescoping sections.

18. The roof brush of claim 13 wherein said vertical arm is comprised of at least two telescoping sections.

19. A method of cleaning a roof using a roof brush, said roof brush comprising a horizontal arm pivotally connected to a vertical arm at a pivot assembly, said horizontal arm pivoting freely relative to said vertical arm during a cleaning stroke, and a cleaning head disposed at an extreme of said horizontal arm opposite said vertical arm, said roof comprising a roof edge, said method comprising the steps of:

A. Positioning said roof brush such that said horizontal arm extends from said roof edge over said roof, said pivot assembly extends beyond said roof edge, and said vertical arm hangs down from said pivot assembly;

B. Initiating said cleaning stroke by pulling said vertical arm away from said roof edge, and decreasing an angle between the horizontal arm and the vertical arm, C. During said cleaning stroke, allowing gravity and the freely pivoting nature of said connection between said horizontal arm and said vertical arm to hold said cleaning head in contact with said roof; and D. Ceasing said cleaning stroke when said cleaning head has been pulled to said roof edge.

20. The method of cleaning a roof using a roof brush of claim 19 comprising the further steps of:

E. Using said roof edge as a fulcrum for said horizontal arm;

F. Pulling down on said vertical arm, said horizontal arm pivoting relative to said vertical arm, until said cleaning head is out of contact with said roof;

G. Twisting said vertical arm until said cleaning head has swung to a new position on said roof, and H. Allowing said cleaning head to descend into contact with said roof.

21. The method of cleaning a roof using a roof brush of claim 19 wherein said roof brush further comprises a cleaning head horn attached to said cleaning head, said cleaning head horn extending from said cleaning head in a direction substantially opposite a direction said horizontal arm extends from said cleaning head, said method comprising the further steps of pulling said cleaning head too far during a stroke such that it is pulled out beyond said roof edge, and permitting said cleaning head horn to save said cleaning head from falling off said roof.

22. The method of cleaning a roof using a roof brush of claim 19 wherein each said horizonital arm and said vertical arm comprise at least two telescoping sections, said method comprising the additional step of extending or retracting said telescoping sections so that said roof brush is appropriately sized to clean said roof before initiating cleaning.

23. The method of cleaning a roof using a roof brush of claim 19 wherein said roof brush further comprises a cleaning head manifold and bristles, said cleaning head manifold communicates with an outside of said cleaning head through at least one cleaning head aperture disposed at said cleaning head bristles, said horizontal arm comprises a horizontal arm bore communicating with said cleaning head manifold, said horizontal arm bore communicating with an outside of said horizontal arm through a hose attachment, said method comprising the further steps of attaching a hose to said hose attachment, and pumping cleaning solution through said horizontal arm manifold, said cleaning manifold and said at least one cleaning head aperture to said bristles.

* * * * *